United States Patent [19]

Phillion, Sr.

[11] Patent Number: 4,753,386

[45] Date of Patent: Jun. 28, 1988

[54] RESIDENTIAL MAILBOX

[76] Inventor: Donald W. Phillion, Sr., 203 Carlisle Way, Rainbow City, Ala. 35901

[21] Appl. No.: 946,904

[22] Filed: Dec. 29, 1986

[51] Int. Cl.[4] ..... B65D 91/00

[52] U.S. Cl. ..... 232/43.1; 232/17; 232/48

[58] Field of Search ..... 232/17, 43.1, 43.2, 232/47, 48, 35, 34

[56] References Cited

U.S. PATENT DOCUMENTS

| | | | |
|---|---|---|---|
| 2,853,230 | 9/1958 | Hays | 232/35 |
| 3,270,956 | 9/1966 | Mullner | 232/35 |
| 3,401,875 | 9/1968 | Bruhns | 232/48 X |
| 3,589,329 | 6/1971 | Schuh | 232/35 |
| 3,758,027 | 9/1973 | Morgan | 232/17 |

*Primary Examiner*—Robert W. Gibson, Jr.
*Attorney, Agent, or Firm*—Donald W. Phillion, Sr.

[57] ABSTRACT

An improved mailbox comprising a first tubular shaped compartment (18) with side walls and a flat bottom (50), a hinged front door (22) and a first pivotal flag assembly (170, FIG. 10) which is normally raised by the homeowner when he places mail in the mailbox for the postman to pick up and then lower the flag assembly, a second pivotal flag assembly (24), a first cable arrangement (40) responsive to opening of the front door to raise the second flag assembly (24) and leave it raised when the front door is closed to advise the homeowner that the postman has come, and a fastening arrangement (156 FIG. 9) for disabling the first cable arrangement by the homeowner when he is away from home, so no one will know that mail is in the mailbox. A second compartment (92) positioned below the first compartment (90) comprises a lockable rear door (112) therein. The flat bottom of the first compartment (90) is separated longitudinally along its length into first and second substantially equal sections (60 and 62 FIG. 4), with hinging means securing the edges of the first and second sections (60 and 62) to the side walls of the first compartment to enable the first and second sections (60, 62) to swing downwardly into the second compartment (92) where they normally will remain, thus leaving the first compartment (90) opened into the second compartment (92) to allow mail placed in the first compartment (90) to fall into the second compartment (92). A second cable arrangement (64, 66) responds to the opening of the front door (22) to pull up the first and second sections, while the front door is opened, into a common horizontal plane to form the flat bottom (50) of the first tubular type mailbox, and a locking arrangement (126, 130 FIG. 8) for locking the first and second sections into the common horizontal plane to receive mail.

8 Claims, 3 Drawing Sheets

RESIDENTIAL MAILBOX

This invention relates generally to mailboxes and more particularly to improvements in rural type mail boxes usually comprising an elongated box-like receptacle with a hinged access door at one end thereof for receiving and retrieving mail and support by a vertically mounted post or support near the road where the mailman has easy access thereto.

BACKGROUND OF THE INVENTION

The relevant prior art rural type mailboxes, as mentioned above, consist of an elongated box-like first receptacle or compartment having a rounded top section and a hinged door which can be opened for receiving and for retrieving mail. They also usually have a pivotal arm assembly consisting of an arm with a flag attached to one end thereof and pivotally attached to its other end to the side of the mail box. The entire flag assembly can be either pivoted to its upright position so that the first flag assembly is visible over the top of the box or pivoted to its downward position so that the flag is not visible over the top of the mailbox. Stops are provided to define the limits of the upright position and the downward position. Conventionally, the homeowner places the flag assembly in its upright position when he places mail in the box for the postman to pick up. The postman picks up the homeowner's mail he finds in the box, leaves any new mail therein and then lowers the flag assembly to its downward position. The entire mailbox assembly is usually mounted on a vertically mounted post near the road. The homeowner is then made aware of the arrival of the postman by noting that the flag is down, which he can often do from a window in his home.

Also, if the homeowner is gone for a day or more and mail accumulates in his mailbox, there is some risk that it will be stolen, especially if there is reason for someone who is aware of the homeowner's absence to believe there might be a check in the homeowner's mail.

A primary object of the invention is to provide an improved rural type mailbox which will advise the homeowner from a distance when the postman has placed mail in his mailbox.

A second object of the invention is to provide an improved rural type mailbox which will have a second compartment to store mail accumulated over a week or more but will still appear to be a quite conventional rural type mailbox, even to the postman.

A third object of the invention is to provide such an improved rural type mailbox in which the stored, accumulated mail is not only not visible to anyone opening the mailbox door but is in fact inaccessible by anyone except the homeowner.

A fourth object of the invention is the improvement of rural type mailboxes generally.

A first primary feature of the present invention is to provide an improved rural type mailbox comprising a first compartment and both a first conventional prior art type flag assembly, partially attached to a first side of the mailbox, and a second pivotal flag assembly attached to the second side of the box other than that to which the first flag assembly is attached and also consisting of an arm pivotally connected to the other side of the mailbox and a flag attached to the other end thereof with the flag assembly having an upright position where the flag is positioned to be visible over the top of the mailbox and a downward position where flag is not visible over the top of said box, and stops to limit the swing of the flag assembly in the upright and downward positions, and with the second flag assembly responsive to the opening of the door to assume its upright position to advise the homeowner that the postman has placed mail in his mailbox and which will remain in an upright position until the homeowner picks up his mail and then manually places the second flag assembly in its downward position, and means for disabling the second flag assembly.

A second primary feature of the invention consists of a second compartment positioned directly underneath the first compartment and separated therefrom by an openable two section partition with the first and second sections of the partition being secured by hinges to the opposite inner sidewalls of the bottom of the first compartment longitudinally along the length of the first compartment and responsive to the door being opened to assume their raised positions where they form a continuous flat, horizontal bottom to the first compartment and responsive to the door being closed to assume their open or downward position to completely open up the bottom of the first compartment to allow any mail that was placed therein to drop into the second compartment and a lockable access door at the rear of the lower compartment to allow the homeowner to retrieve his mail.

A third feature of the invention consists of means for the homeowner to lock the first and second sections together in their raised position while he is at home every day and can pick up his mail daily.

A fourth feature of the invention is the combination of the aforementioned first, second, and third features to enable the homeowner to enable his mailbox to function as a conventional rural type mailbox while he is at home with the additional advantage of having the second flag assembly advise him when the mailman has left mail in the mailbox and to enable his mailbox to appear to function exactly as a conventional rural type mailbox does (with the second flag assembly disabled) when he is away from home, but with the daily mail in fact actually accumulating in the lower compartment.

BRIEF STATEMENT OF THE INVENTION

In accordance with a preferred form of the invention there is provided an improved mailbox of the type consisting generally of a tubular shaped first compartment with side walls and a flat bottom, a hinged front door, and a first pivotal flag assembly which is normally raised by the homeowner when he places an item of mail in the mailbox for the postman to pick up and who then normally lowers the first flag assembly, and comprising a second pivotal flag assembly, a first cable arrangement connected to be responsive to the opening of the front door to raise the second flag assembly and to leave it in a raised position when the front door is closed to advise the homeowner that the postman has left mail in the mailbox, and second means for disabling the first cable by the homeowner when for some reason he is away from home, as when he is on vacation, so that no one will be aware that mail might be in the mailbox, a second compartment positioned below the first compartment and comprising a lockable rear door therein, the flat bottom of the first compartment being separated longitudinally along its length into first and second substantially equal sections, a hinging arrangement for securing those edges of the first and second sections nearest the side walls of the first compartment to the sidewalls to enable the first and second sections to swing downwardly into the second compartment where they normally will remain, thus leaving the first compartment opened into the second compartment to enable mail placed in the first compartment opened into the second compartment, a second cable arrangement responsive to the opening of the front door to pull up the first and second sections, but only while the front door is opened, into a common horizontal plane simulating the original flat bottom of the first compartment, and a locking arrangement for locking the first and second sections into the substantially horizontal plane simulating the original flat bottom of the first compartment to receive mail as in a conventional prior art mailbox and with the second flag assembly in an enabled state.

The above-mentioned and other objects and features of the invention will become more apparent from the detailed description of the drawings in which.

Figure 7:
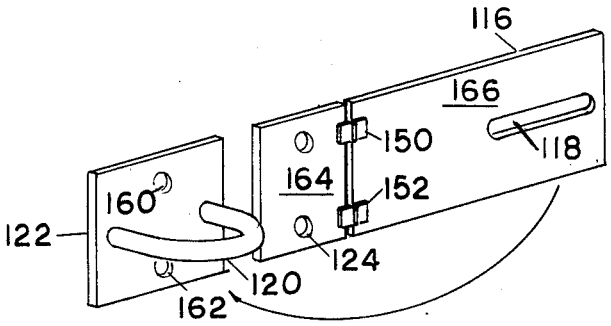
Figure 8:
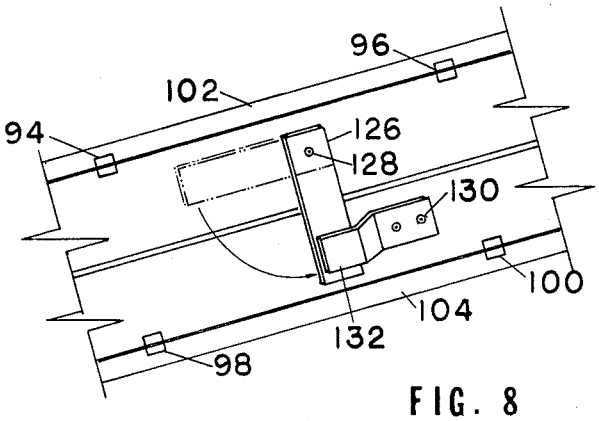
Figure 9:
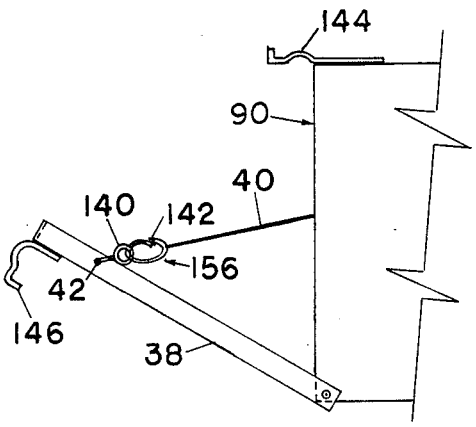
Figure 10:
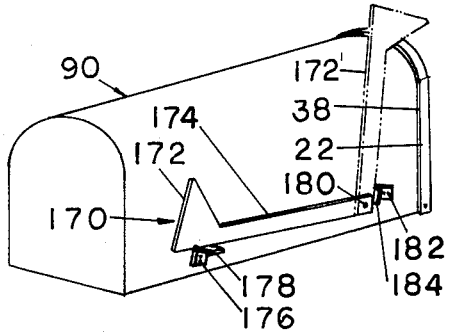

FIG. 7 shows a view of a latch and hasp the homeowner can use to lock a second, rear door in the back of the lower compartment to retrieve mail that has dropped into such lower compartment, and also to lock and unlock the locking structure shown in FIG. 8 for permananently securing the aforementioned openable partition in its closed position, and thus separating the upper compartment from the lower;

FIG. 8 shows the locking structure mentioned above to permanently secure the openable partition in its closed position;

FIG. 9 shows a snap hook arrangement for disabling the second flag assembly so that it always remains in its lowered position; and FIG. 10 shows a first, conventional flag assembly which is raised by the homeowner when he places mail in his mailbox before the mailman arrives to advise the mailman that there is mail in the box to be picked up by the mailman.

DETAILED DESCRIPTION OF THE INVENTION

The invention is divided into two main cooperative portions. The first portion is shown primarily in FIGS. 1, 2, and 3 and the second portion is shown primarily in FIGS. 4, 5, and 6.

The first portion shown in FIGS. 1, 2, and 3 will be described first and then the second portion shown in FIGS. 4–6 will be described. Finally, the cooperative relation between the two portions will be described.

Figure 1:
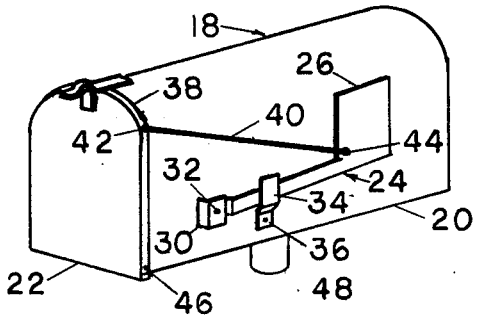
FIG. 1 shows a first isometric view of one feature of the invention which involves the second flag assembly and more specifically shows the first compartment only with the front door closed and the second flag assembly in its lowered position.

In FIG. 1 an almost typical rural type mailbox 18 is shown which consists of a mail container 20, a hinged door 22, and a flag-arm assembly 24, all of which are mounted on a vertically positioned supporting pole or mast 48, the lower end of which is secured in the ground by suitable means.

Obviously, means other than a post can be used to support the mailbox in the ground, such as a wrought iron filigreed panel-like support, for example.

The inventive feature lies in the structure which operates the flag assembly 24 in cooperation with the opening and closing of the door 22. More specifically, the flexible cord 40, which is secured at one end by suitable means 42 to the door 22 and at its other end by other suitable means 44 to the arm 28 of flag assembly 24, is shown in a relatively taut position in FIG. 1 with the arm 28 of flag assembly 24 resting in bracket 34, which is secured to main box 20 by suitable fastening means 36 such as a bolt and a nut, or a rivet. It can be seen in FIG. 1 that with the door 22 closed the flag assembly 24 is in a substantially horizontal down position and the flag 26 is not visible over the top of the mail box 20.

Figure 2:
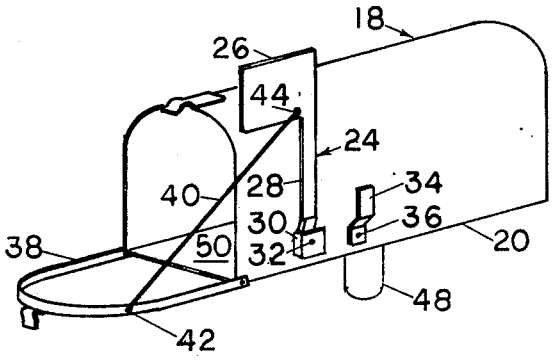
FIG. 2 shows an isometric view similar to that of FIG. 1 but with the front door opened to raise the second flag assembly to its raised position.
Figure 3:
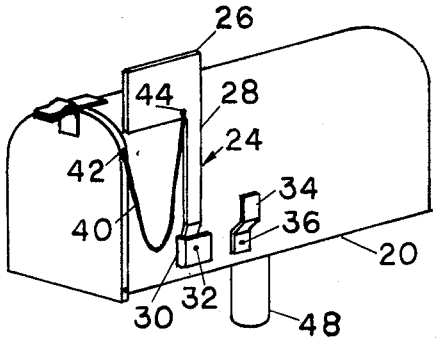
FIG. 3 shows an isometric similar to that of FIGS. 1 and 2 but immediately after the door has been closed and before the homeowner has picked up his mail and lowered the flag assembly back to its lowered position.

When the door 22 is opened by the postman, as shown in FIG. 2, to insert incoming mail the taut cord 40 will pull the arm 28 of flag assembly 24 to a substantially upright position, pivoting arm 28 around pin 32, secured in bracket 30 which in turn is secured to main box 20, as shown in FIG. 2 so that the flag 26 is visible over the top of the main box 20 and can be seen by the home owner from his window. Thus, it is not necessary for him to make premature and unnecessary trips to the mailbox to see if the daily mail has arrived. It should be noted the flexible cord 40 is now hanging loosely in a non functioning manner.

When the homeowner sees the raised flag 26 and goes out to pick up his mail, he opens door 22, takes out the mail, closes door 22, and then manually pushes flag assembly 24 back to its substantially horizontal position as shown in FIG. 1 and where the flag 26 is no longer visible over the top of the main box 20.

With the mailbox flag assembly and cord 40 in the position shown in FIG. 1 the mailbox is ready to repeat the cycle just described when the next mail is delivered by the postman.

Figure 4:
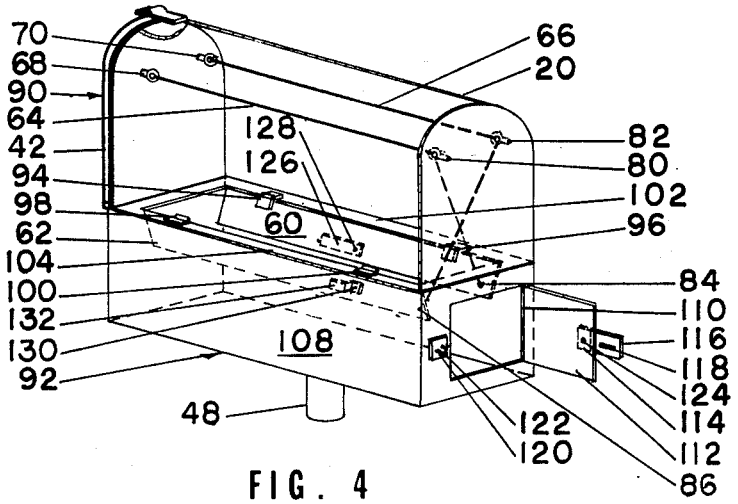
FIG. 4 is an isometric of another feature of the invention involving both compartments and with the front door closed and the openable partition between the two compartments completely open so that mail placed in the upper compartment will drop into the lower compartment.
Figure 5:
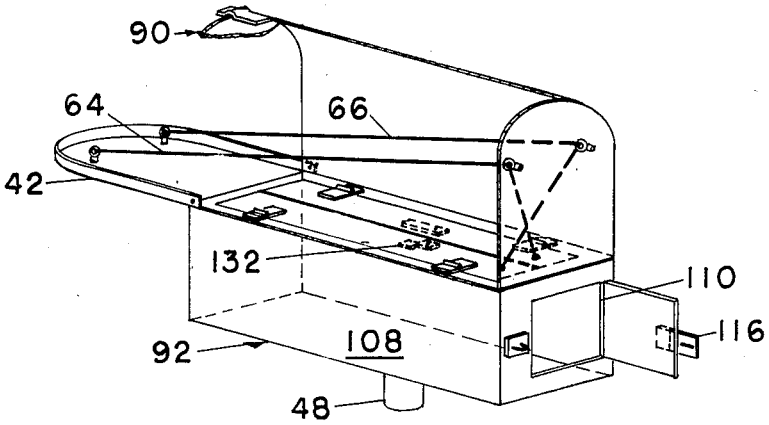
FIG. 5 shows another isometric view similar to that of FIG. 4 but with the front door opened so that the partition separating the upper and lower compartments will be closed to prevent mail placed in the upper compartment from dropping into the lower compartment while the front door is opened.
Figure 6:
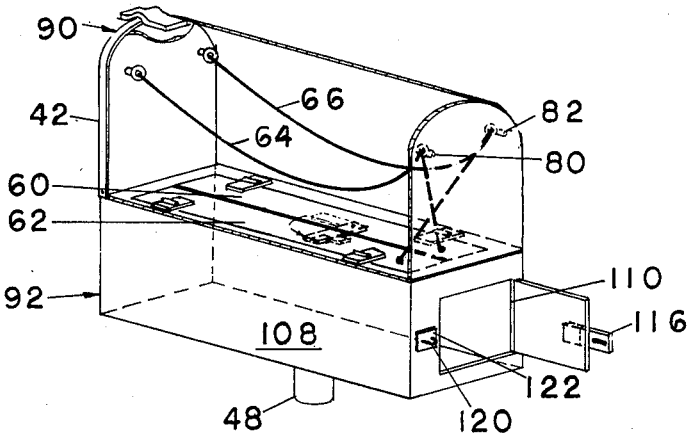
FIG. 6 is another isometric view similar to that of FIGS. 4 and 5 but with the front door again closed and the separating partition again completely open.

Referring now to FIGS. 4, 5, and 6, which show the second portion of the invention, the flag assembly 24, the bracket 34, and the cord 40 are not shown for purposes of simplicity.

In FIG. 4 mailbox is divided into an upper portion 90 and a lower portion 92 separated by a two part openable section which consists of section 60 and section 62. Section 60 is pivotally connected to flange 102 by hinges 94 and 96 which are secured to section 60 and flange 102 by suitable means such as bolts and nuts, rivets, or welding, in such a manner as to permit the section 60 to swing downwardly but limit its upward position to one which is substantially parallel with the bottom 108 of the lower box portion 92, as shown in FIGS. 5 and 6.

In a similar manner section 62 is secured to flange 104 by hinges 98 and 100 and while it can pivot downwardly to the position shown in FIG. 4 it cannot pivot upwardly beyond a parallel relation with the bottom 108 of the lower portion 92, as shown in FIGS. 5 and 6.

When the door 22 is in its closed position, as shown in FIG. 4, the two flexible cords 64 and 66, which are secured at one end to the inside of door 22 at points 68 and 70, then pass through loops 80 and 82, respectively, (secured to the main box 20) and are then secured at their other ends at points 84 and 86, respectively, of half sections 60 and 62, respectively, both in a relaxed condition in that half sections 60 and 62 have pivoted downwardly by force of gravity and the weight of the mail, or spring loaded hinges 94, 96, 98, and 100, to allow any mail which was placed in the upper box portion 90 to drop into the lower box portion 92.

It is to be specifically noted that the half sections 60 and 62 will pivot downwardly to their positions shown in FIG. 4 when door 22 is closed.

When the door 22 is opened as shown in FIG. 5, the flexible cords 64 and 66 are pulled taut and to the left in FIG. 5, pivoting the two half sections 60 and 62 upwardly and into a horizontal position substantially parallel with the bottom 108 of the lower box portion 92, thus forming a completely closed upper box portion 90. However, as soon as the door 22 is closed the two half sections 60 and 62 pivot downwardly into the position shown in FIG. 4, dropping the mail into the lower box portion 92.

The mail can then be retrieved from the lower box portion by the homeowner by his opening rear door 112, which swings on hinges 110, and pulling on latch 116 which is hinged to plate 114, in turn secured to door 112 by suitable means such as volts or rivets 124, or welding. The door 112 can be made slightly larger than the opening it covers to prevent the door 112 from swinging inwardly into lower box portion 92.

If desired, the rear door 112 can be padlocked by swinging latch 116, hinged to plate 114 which is secured to lower compartment 92 by means 124, over and unto hasp 120. The slot 118 in latch 116 is positioned to so fit. The hasp 120 is secured to plate 122 as by welding and plate 122 is secured to the rear face of the lower box portion 92 of the mailbox. For a more detailed illustration of latch 116, hasp 120, and their operation reference is made to FIG. 7.

Often, the homeowner would not want to use the lower box portion 92 if he were home and would simply prefer to open the front door 22 to retrieve the mail.

To provide for those conditions there is provided a bar 126 which is rotatably secured to one of the half sections 60 by suitable means 128 such as a bolt or a rivet. The bar remains parallel with the long edge of the half section 60 when it is desired to use the lower box portion 92.

If the homeowner desired to use only the upper box portion 90 the bar 126 is rotated 90° so that one end thereof slides into the bent-over receiving clip 130 and under the raised and extended top portion 132, thus locking the two half sections together in a substantially horizontal plane which is parallel to the bottom 108 of the lower box portion 92. It is to be understood, however, that in order to accomplish the above-described action the rear door 112 must be opened and the homeowner must reach in and raise the two half sections 60 and 62 to a level horizontal position, and then pivot the bar 126 90° so that one end thereof becomes locked under the bent-over and back portion 132 of clip 130. The rear door 112 can then be closed and padlocked, if desired, and the two half sections 60 and 62 will never open up, so that the homeowner essentially now has only the well known rural mail box and will retrieve his mail through the front door 22. For a detailed illustration of bar 128 and clip 130 and their operation reference is made to FIG. 8.

During those times the homeowner does not want to indicate that he has received mail, as when he is on vacation, he can disengage the flexible cord 40 from the door 22 and let it hang loose. Then when door 22 is opened the flag assembly 24 will not be raised. Detailed structure for disengaging cord 40 is shown in FIG. 9 and consists of a snap hook 156 which fits around a ring 140 secured in edge 38 of door 22 by securing means 42. Cord 40 is tied to one end of snap hook 156. When portion 142 of snap hook 156 is depressed it can be removed from ring 140 and cord 40 becomes disengaged.

Thus the flag assembly 24 cooperates with the two compartment mailbox so that when the homeowner is gone and wants the mail to accumulate in the lower box portion 92 he disengages flag assembly 124 so that no one is aware of mail being in the mailbox. On the other hand when the homeowner is home and picks up his mail every day he will engage flag assembly 124 and position bar 126 (FIG. 4) to become locked in clip 130 so that the mail will not drop into the lower box portion 92 when door 22 is closed.

Referring now to FIG. 7, there is shown a more detailed illustration of the latch 116 and hasp 120 shown in FIGS. 4, 5, and 6. The latch 116 is in two sections 164 and 166 joined together by hinges 150 and 152 so that when section 166 is pivoted back over hasp 120, the hasp 120 will fit within slot 118 and a padlock can be inserted through that portion of hasp 120 which protrudes through slot 118, thus locking door 112 securely closed. Plates 114 and 122 are secured respectively to door 112 and the rear panel of the lower box portion 92 of the mailbox by securing elements 124, 160, and 162, which can be bolts or rivets, or, the plates 114 and 122 can be welded to door 112 or the aforementioned rear panel of the lower box portion 92.

Referring now to FIG. 8 the bar 126 and clip 130 of FIGS. 4, 5, and 6, and their operation can be seen more clearly. When the two half sections 60 and 62 are to swing into the lower box portion when door 22 of FIG. 1 is closed the bar 126 is in the position shown in dotted lines. However, when the two half sections 60 and 62 are to remain together in substantially the same plane, as shown in FIG. 6, the bar 126 is in the position shown by the solid lines and one end thereof locks under the raised and extended portion 132 of clip 130.

Referring now to FIG. 10 there is shown a second flag assembly 170 position on the upper box portion on the side opposite that of flag assembly 24 of FIG. 1. The purpose of the second flag assembly 170 is that of the conventional flag assembly in that it can be raised before the postman arrives to advise the postman that there is mail in the mailbox to be picked up by the postman and placed in the U.S. mail system for mailing.

Stops 176 and 182, which are secured to the side of the mailbox by suitable means such as bolts, rivets, or welding, are provided to limit the swing of flag assembly 170. More specifically, the raised portion 178 of stop 176 limits the amount of downward swing of flag assembly 170 which is pivotal around a suitable means 180, which can be a bolt or a rivet. The raised portion 184 of stop 182 limits the upward swing of flag assembly 170.

The flag assembly 170 can consist of a flag portion 172, which can be triangular or circular in shape and an arm 174 to which the flag 172 is attached. The flag 172 preferably has a shape different from that of flag 26 of FIG. 1 and preferably is also of a different color such as orange, while flag 26 could be red, or the colors could be reversed, or both could be changed to different colors.

It is to be understood that the forms of the invention shown and described herein are but preferred embodiments thereof and that various changes and modifications can be made thereto without departing from the spirit or scope of the invention and without the exercise of further invention.

I claim:

1. An improved mailbox comprising:

a tubular shaped first compartment with side walls and an openable flat bottom;

a hinged front door;

a first pivotal flag assembly which is normally raised by the homeowner when he places an item of mail in the mailbox for the postman to pick up and who then normally lowers said first flag assembly;

a second pivotal flag assembly having an enabled state and a disabled state;

first means comprising flexible cable means connecting said front door to said second flag assembly and responsive to the opening of said front door to raise said second flag assembly when said second flag assembly is in its enabled state and to leave it in a raised position when said front door is closed to advise the homeowner that the postman has left mail in the mailbox; and second means for disabling said first means by the homeowner when for some reason, as when the homeowner is on vaction, so that no one will be aware that mail might be in the mailbox;

a second compartment positioned below said first compartment and comprising a lockable rear door therein;

said flat bottom of said first compartment being separated longitudinally along its length into first and second substantially equal sections;

hinging means for securing those edges of said first and second sections nearest the side walls of said first compartment to said side walls and enabling said first and second sections to swing downwardly into said second compartment where they normally will remain by force of gravity and in the absence of other forces, thus leaving the first compartment opened into said second compartment and enable mail placed in said first compartment to fall into said second compartment;

third means comprising second flexible cable means connecting said front door to said first and second sections and responsive to the opening of said front door to pull said first and second sections upwardly, while said front door is opened, into a common substantially horizontal plane to form the openable flat bottom of said tubular shaped first compartment;

fourth means for locking said first and second sections into said substantially horizontal plane said flat bottom of said tubular shaped first compartment to receive mail and with said second flag assembly in an enabled state.

2. An improved mailbox as in claim 1 in which said second means comprises a detachable fastener which secures said first end of said first flexible cable to said front door.

3. An improved mailbox as in claim 1 in which said fourth means comprises:

a bar pivotally mounted on the bottom surface of said first section of said flat bottom in a manner to enable a first end thereof to pivot to position said bar selectively in a first position entirely underneath said first section or in a second position with said first end thereof extending underneath the bottom surface of said second section;

clip means secured on the bottom surface of said second section to receive said first end of said bar and to lock it securely in place so that substantially no vertical motion of said first end of said bar can occur and said first and second sections will form the flat bottom of said tubular shaped first compartment into a substantially rigid, horizontal surface to completely separate said first compartment from said second compartment; and in which said second flexible cable means is comprised of two flexible cables with their first ends secured to said front door and their second ends secured respectively to said first and second sections to pull up said first and second sections from their downward positions to form a substantially horizontal planar surface in response to the opening of said front door.

4. An improved rural type mailbox for receiving mail and comprising:

a metal box divided into first and second compartments being separated by an openable panel secured along its outer sides to the side walls of said metal box and with both compartments having elongated shapes and with said first compartment being positioned on top of said second compartment;

said first compartment comprising a first door at a first end thereof and said second compartment comprising a second door at the opposite end of said second compartment;

first and second flag assemblies pivotally secured on opposite outer sidewalls of said first compartment and each having a lowered position where the flat is not visible over the top of said first compartment and a raised position wherein the flag is visible over the top of said first compartment;

said openable panel having a closed position in which said first and second compartments are closed off from each other, and an open position in which said first and second compartments are completely open to each other and being comprised of first and second rectangularly shaped sections of substantially the same size and shape;

said first and second sections of said openable panel further being hinged to the sidewalls of said metal box in a manner to enable said first and second sections to swing down by gravity into said second compartment when said openable panel is in its open position and to have an upward swing limited to having said first and second sections lie in a common plane to cause said openable panel to be in its closed position;

first means responsive to the closing of said first door to enable said first and second sections of said openable panel to assume their open positions and to the opening of said first door to assume their closed position;

second means accessible from said second door for permanently locking said first and second sections in their closed position by the homeowner for as long a period as he desires as when he is home and picks up his own mail every day; and third means responsive to the opening of said first door to place mail therein, for example, to raise said second flag assembly to its raised position and to leave said second flag assembly in its raised position after said first door is closed so that the homeowner can see that the mail has arrived; and fourth means for disabling said third means to leave said second flag assembly in its lowered position, as when the homeowner is on vacation away from home, when said openable panel is in its open position in response to the closed position of said first door to form a cooperative relation between said second flag assembly and the operation of said openable panel.

5. An improved mailbox as in claim 4 comprising locking means for locking said second door in a closed position.

6. An improved mailbox of the type consisting generally of a tubular shaped first compartment with side walls and a flat bottom, a front door, hinged to swing downwardly when opened and a first pivotal flag assembly which is normally raised by the homeowner when he places an item of mail in the mailbox for the postman to pick up and who then normally lowers said first flag assembly, and comprising:

a second pivotal flag assembly;

first means comprising a first flexible cable means connected between said second flag assembly and said front door near the edge of said front door and away from the top thereof at a point so that said flexible cable lies in a substantially straight line when said front door is opened and does not obstruct the opening into said first compartment, and responsive to the opening of said front door to raise said second flag assembly and to leave it in a raised position when said front door is closed to advise the homeowner that the postman has left mail in the mailbox; and second means comprising a detachable fastener to enable disconnection of said flexible cable means between said front door and said second flag assembly by the homeowner when for some reason, he is away from home, as when he is on vacation, to prevent the raising of said second flag assembly when said front door is opened, so that no one will be aware that mail might be in the mailbox.

7. An improved mailbox comprising:

a tubular shaped first compartment with side walls and an openable flat bottom;

a hinged front door;

a first pivotal flag assembly which is normally raised by the homeowner when he places an item of mail in the mailbox for the postman to pick up and who then normally lowers said first flag assembly; and a second pivotable flag assembly having a lowered horizontal position alongside said mailbox and a raised, substantially vertical position;

first detachable flexible cable means connecting, when not detached, said second flag assembly to said front door to pull said second flag assembly to its raised position when said front door is opened and to flex when said front door is closed to leave said second flag assembly in its raised position, and to leave said second flag assembly in its lowered position when it is detached;

a second compartment positioned below said first compartment and comprising:

a lockable rear door therein;

said flat bottom of said first compartment being separated longitudinally along its length into first and second substantially equal sections;

hinging means for securing those edges of said first and second sections nearest the side walls of said first compartment to said side walls and enabling said first and second sections to swing downwardly by force of gravity into said second compartment where they normally will remain, unless swung upwardly an applied force, thus leaving the first compartment opened into said second compartment to enable mail placed in said first compartment to fall into said second compartment;

first means comprising second flexible cable means connected between said front door and first and second sections and responsive to the opening of said front door to pull up said first and second sections, but only while said front door is opened, into a common horizontal plane to form the flat bottom of said first compartment; and second means for locking said first and second sections into said substantially horizontal plane to receive mail.

8. An improved mailbox as in claim 7 in which said second means comprises:

a bar pivotally mounted on the bottom surface of said first section of said flat bottom in a manner to enable a first end thereof to pivot to position said bar selectively in a first position entirely underneath said first section or in a second position with said first end thereof extending underneath the bottom surface of said second section;

clip means secured on the bottom surface of said second section to receive said first end of said bar and to lock it securely in place so that substantially no vertical motion of said first end of said bar can occur and said first and second sections will form a substantially rigid, horizontal surface to completely separate said first compartment from said second compartment; and in which said first means is comprised of two flexible cords or cables with their first ends secured to said front door and their second ends secured respectively to said first and second sections to pull up said first and second section from their downward positions to form a substantially horizontal planar surface in response to the opening of said front door.

* * * * *